United States Patent [19]

Lassanske

[11] Patent Number: 4,831,820

[45] Date of Patent: May 23, 1989

[54] ENGINE WITH EXHAUST GAS SENSING

[75] Inventor: George G. Lassanske, Oconomowoc, Wis.

[73] Assignee: Outboard Marine Corporation, Waukegan, Ill.

[21] Appl. No.: 131,449

[22] Filed: Dec. 11, 1987

[51] Int. Cl.[4] ..... F01N 3/00

[52] U.S. Cl. ..... 60/276

[58] Field of Search ..... 60/276

[56] References Cited

U.S. PATENT DOCUMENTS 4,215,538 8/1980 Steinwart ..... 60/276

4,364,226 12/1982 Croset ..... 60/276

*Primary Examiner*—Douglas Hart

*Attorney, Agent, or Firm*—Michael, Best & Friedrich

[57] ABSTRACT

Disclosed herein is a two-stroke internal combustion engine comprising an engine block including therein a combustion chamber, a piston, an exhaust passage communicable with the combustion chamber for conducting gas away from the combustion chamber, and structure for sensing a condition present in the combustion chamber gas at a time near the end of the power stroke and including a passage communicable between the combustion chamber and the exhaust passage and having therein a sensor for sensing a condition present in the gas flow in the passage.

5 Claims, 1 Drawing Sheet

Figure 2:
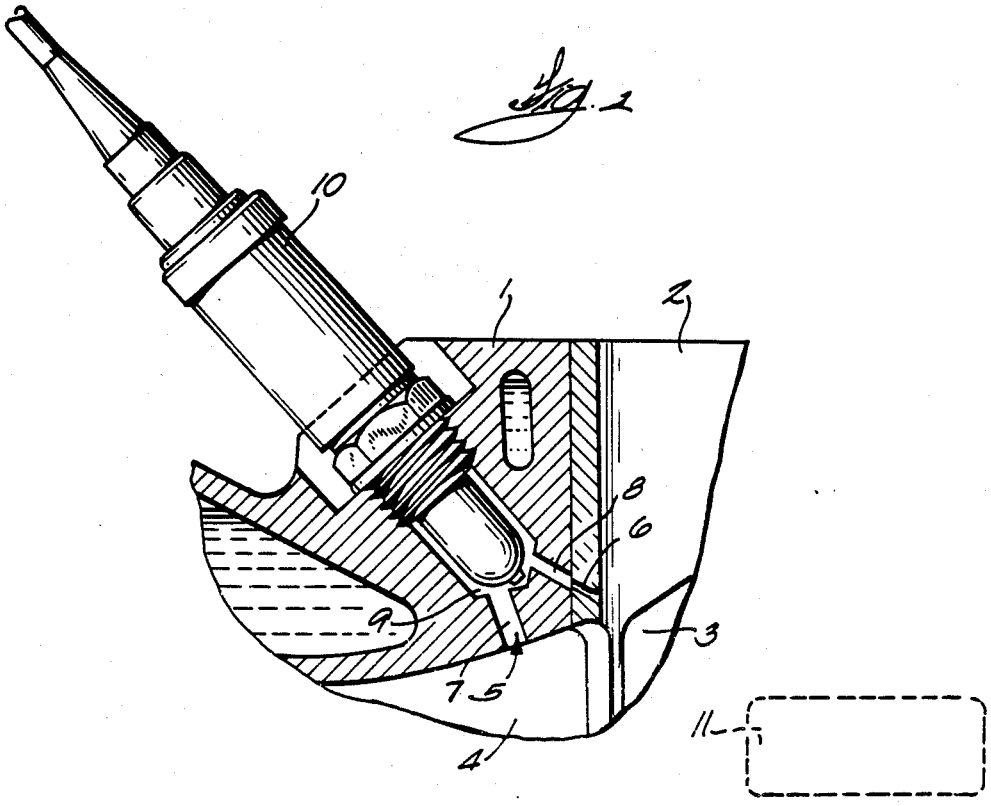

10
1
2
8
6
9
3
7
5
4
11

ENGINE WITH EXHAUST GAS SENSING

BACKGROUND OF THE INVENTION

The invention relates generally to two stroke internal combustion engines. In addition, the invention relates to detection of a condition in the combusted fuel-air mixture of two stroke internal combustion engines.

SUMMARY OF THE INVENTION

The invention provides a two stroke internal combustion engine comprising an engine block including therein a combustion chamber, an exhaust passage communicable with the combustion chamber for conducting combusted air-fuel mixture away from the combustion chamber, and means for sensing a condition present in the combusted air-fuel mixture and including passage means communicable between the combustion chamber and the exhaust passage and having therein means for sensing a condition present in the flow of combusted air-fuel mixture in the passage means.

The invention also provides a two-stroke internal combustion engine with an apparatus to sense a condition present in the combusted air-fuel mixture, which internal combustion engine comprises an engine block including therein a combustion chamber, a piston, an exhaust pipe communicable with the combustion chamber, means for supplying fuel and air to the combustion chamber, and passage means for conducting combusted fuel-air mixture from the combustion chamber to the exhaust pipe and including means for sensing a condition in the combusted fuel-air mixture, and means for restricting gas flow into the passage means prior to closure by the piston of the passage means from the combustion chamber to the sensing chamber to thereby prevent the introduction of fresh fuel-air mixture present in the combustion chamber during the compression stroke to the condition sensing means.

In one embodiment of the invention, the passage means for conducting combusted fuel-air mixture from the combustion chamber to the exhaust pipe is a passage with opposite ends, one passage end opening into the combustion chamber at a location above the exhaust pipe, the other passage end communicating with the exhaust pipe.

A principal feature of the invention is to provide means for sensing a combusted fuel-air mixture condition comprising a device to sense the presence of oxygen in the combusted fuel-air mixture.

It is an object of the invention to provide means for measuring a condition in the combusted fuel-air mixture of a two-stroke engine by separating a portion of free flowing combusted fuel-air mixture as a measurement sample while maintaining an unobstructed flow of exhaust gas.

Other features and advantages of the embodiments of the invention will become known by reference to the following general description, claims and appended drawings.

THE DRAWINGS

FIG. 1 is a fragmentary sectional view of an engine block embodying various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown fragmentarily in FIG. 1 is a two stroke internal combustion engine which includes an engine block 1, a combustion chamber formed by a cylinder 2, a piston 3 and an exhaust pipe 4. In addition, conventional means are provided for supplying fuel-air mixture to the combustion chamber, which fuel-air mixture supplying means comprises a transfer port 11 shown in dotted outline. Alternatively, fuel could be supplied by injection into the cylinder 2 and fresh air could be supplied through the transfer port 11.

As shown in FIG. 1, the engine also includes means for sensing or measuring a condition present in the combusted air-fuel mixture during the exhaust stroke. While various other arrangements could be employed, in the disclosed construction, such sensing means includes means for sensing a condition present in the combusted air-fuel mixture during the exhaust stroke and passage means for allowing fluid communication between the cylinder 2 and the exhaust pipe 4.

While other construction an be employed, in the disclosed and illustrated construction, the passage means provides for minimal loss of power during the power stroke, and for exclusion from the sensing means of fuel and air in the fresh charge present in the combustion chamber during the compression stroke. Preferably, the passage means comprises a passage 5 communicating with the cylinder 2 at a position slightly above the juncture of the cylinder 2 and exhaust pipe 4, thereby facilitating unobstructed flow of combusted air-fuel mixture as a sample for measurement before the opening of the exhaust port. The passage means also includes means for restricting the flow in the passage 5 such that flow occurs only when the pressure in the cylinder 2 is above the pressure which is present immediately prior to opening of the exhaust port. Consequently, flow in the passage 5 from the cylinder 2 occurs only prior to exhaust port opening, and is exclusively combusted air/fuel mixture. While other constructions can be employed, in the illustrated construction, such means is in the form of a restrictive orifice 6, located at the passage end which opens into the combustion chamber 2.

Preferably, the passage means includes two passage portions 7 and 8 and an enlarged sensing chamber 9 which communicates between the passage portions 7 and 8 and which includes therein a device 10 which performs the desired measurement of a condition in the combusted air-fuel mixture. While other constructions can be employed, in the illustrated construction, the device 10 preferably comprises an oxygen sensor which measures the oxygen present in the combusted air-fuel mixture and which can be of any conventional construction.

Various of the features of the invention are set forth in the following claims.

I claim:

1. A two-stroke internal combustion engine comprising an engine block including therein a combustion chamber having an exhaust port, an exhaust passage extending from said exhaust port for conducting combusted air-fuel mixture away from said combustion chamber, and means for sensing a condition present in the combusted air-fuel mixture flow and including passage means extending between said combustion chamber and said exhaust passage in by-passing relation to said exhaust port, and having therein a sensor for sensing a condition present in the flow of combusted air-fuel mixture in the passage means.

2. A two-stroke internal combustion engine with an apparatus to sense a condition present in the combusted air-fuel mixture, said engine comprising an engine block including therein a combustion chamber, a piston, an exhaust pipe communicable with said combustion chamber, means for supplying fuel and air to said combustion chamber, and passage means for conducting combusted air-fuel mixture from said combustion chamber to said exhaust pipe, said passage means including means for sensing a condition in the combusted air-fuel mixture, and means for restricting gas flow into said passage means prior to closure by said piston of said passage means from said combustion chamber to thereby prevent the introduction of air-fuel mixture present in the combustion chamber during the compression stroke to said condition sensing means.

3. A two stroke internal combustion engine in accordance with claim 2 wherein said passage means comprises a passage with opposite ends, one end opening into said combustion chamber at a location above the exhaust pipe, the other end communicating with said exhaust pipe.

4. A two stroke internal combustion engine in accordance with claim 3 wherein said means for sensing a condition present in the combusted fuel-air mixture is a device for sensing the presence of oxygen in the gas in said passage means.

5. A two stroke internal combustion engine in accordance with claim 2, wherein said means for sensing a condition present in the combusted fuel-air mixture in said passage means is a device for sensing the presence of oxygen in the combusted fuel-air mixture in said passage means.

* * * * *